US011043148B2

(12) United States Patent
Kent et al.

(10) Patent No.: US 11,043,148 B2
(45) Date of Patent: Jun. 22, 2021

(54) PAINT TESTER

(71) Applicants: Melinda Miller Kent, Shreveport, LA (US); Konstantin Dolgan, Shreveport, LA (US)

(72) Inventors: Melinda Miller Kent, Shreveport, LA (US); Konstantin Dolgan, Shreveport, LA (US)

( * ) Notice: Subject to any disclaimer, the term of this patent is extended or adjusted under 35 U.S.C. 154(b) by 65 days.

(21) Appl. No.: 16/352,235

(22) Filed: Mar. 13, 2019

(65) Prior Publication Data

US 2020/0219422 A1 Jul. 9, 2020

Related U.S. Application Data

(60) Provisional application No. 62/789,626, filed on Jan. 8, 2019.

(51) Int. Cl.

| | |
|---|---|
| ***G09F 5/02*** | (2006.01) |
| ***B05C 17/005*** | (2006.01) |
| ***B65D 41/02*** | (2006.01) |
| ***B65D 41/62*** | (2006.01) |
| ***B65D 41/32*** | (2006.01) |

(52) U.S. Cl.

CPC ..... *G09F 5/02* (2013.01); *B05C 17/00516* (2013.01); *B65D 41/023* (2013.01); *B65D 41/325* (2013.01); *B65D 41/62* (2013.01); *B65D 2221/00* (2013.01); *B65D 2251/0015* (2013.01); *B65D 2251/0078* (2013.01)

(58) Field of Classification Search

CPC ..... B65D 47/42; B65D 1/0246; B65D 2251/0025; B65D 2255/20; B65D 47/242; B65D 51/2835; B65D 55/022; B65D 41/023; B65D 41/325; B65D 41/62; B65D 2221/00; B65D 2251/0015; B65D 2251/0078; A45D 2200/1018; A45D 34/042; A45D 40/265; A46B 11/0041; A46B 2200/1046; G09F 5/02; B05C 17/00516

See application file for complete search history.

(56) References Cited

U.S. PATENT DOCUMENTS

| | | | |
|---|---|---|---|
| 4,659,243 | A | 4/1987 | Winson |
| 4,738,358 | A | 4/1988 | Kehl |
| 6,655,746 | B1 | 12/2003 | Weihrauch |

(Continued)

OTHER PUBLICATIONS

"AkzoNobel wins leading packaging innovation award for Flexa wet tester" (AkzoNobe), Nov. 25, 2016, entire document.

*Primary Examiner* — Shawn M Braden

(74) *Attorney, Agent, or Firm* — Holoubek Patent Law, LLC; Charles Holoubek

(57) ABSTRACT

Paint tester and methods of testing paint using the paint tester. The paint tester having a sealed receptacle containing paint, a foam applicator, and a seal cutter. The methods comprising rotating the seal cutter with respect to the receptacle until one or more teeth will cut into and break a seal on the receptacle, applying inward pressure to an exterior surface of a receptacle wall causing paint to flow from the receptacle through a channel exit of the receptacle, through a conduit defined in the seal cutter, out a conduit exit encircled by crenulations, through pores in the applicator, and onto an exterior surface of the applicator, and touching the exterior surface of the applicator to a surface upon which paint is desired.

19 Claims, 10 Drawing Sheets

(56) References Cited

U.S. PATENT DOCUMENTS

| | | | | |
|---|---|---|---|---|
| 7,563,048 | B2 * | 7/2009 | Koptis | A45D 40/26 401/183 |
| 9,066,711 | B2 * | 6/2015 | Ruiz, Sr. | A46B 11/0075 |
| 9,688,443 | B2 * | 6/2017 | Hanten | B65D 75/5872 |
| 2007/0048066 | A1 | 3/2007 | Dumler | |
| 2008/0245314 | A1 * | 10/2008 | Brodowski | A61M 35/003 119/651 |
| 2014/0361016 | A1 * | 12/2014 | Moreau | B65D 51/2835 220/502 |
| 2017/0369210 | A1 | 12/2017 | Defert et al. | |

* cited by examiner

PAINT TESTER

CROSS REFERENCE TO RELATED APPLICATIONS/PRIORITY

The present invention claims priority to U.S. Provisional Patent Application No. 62/789,626, filed Jan. 8, 2019, which is incorporated by reference into the present disclosure as if fully restated herein. Any conflict between the incorporated material and the specific teachings of this disclosure shall be resolved in favor of the latter. Likewise, any conflict between an art-understood definition of a word or phrase and a definition of the word or phrase as specifically taught in this disclosure shall be resolved in favor of the latter.

BACKGROUND OF THE INVENTION

Home owners will periodically desire to repaint walls in their home. However, there is no current option for quickly, easily, and reliably testing various new paint colors that the home owner may want to test before buying the paint in bulk quantities. Though this issue has presented itself innumerable times for over a century, no solution has been presented in the art. For the foregoing reasons, there is a pressing, but seemingly irresolvable need for quick, easy, and reliable paint tester.

SUMMARY OF THE INVENTION

Wherefore, it is an object of the present invention to overcome the above mentioned shortcomings and drawbacks associated with the current technology. The present invention is directed to methods and apparatuses that satisfy the above shortcomings and drawbacks.

The present invention also relates to methods and paint testers comprising a sealed receptacle, an applicator, and a seal cutter. According to a further embodiment the paint tester comprises a cap which removablely encapsulates and provides a substantially fluid tight barrier around the applicator. According to a further embodiment the sealed receptacle includes a base, a receptacle wall, and a channel. According to a further embodiment the channel has a channel walls defining a space in fluid communication with an interior of the receptacle. According to a further embodiment a seal extending over a channel exit provides a fluid tight barrier to the interior of the receptacle. According to a further embodiment the seal cutter engages with an exterior surface of the channel walls. According to a further embodiment the seal cutter has one or more teeth extending in a direction of the seal. According to a further embodiment the seal cutter has a threaded interior surface that mates with a threaded exterior surface of the channel walls, such that when the seal cutter is rotated with respect to the receptacle, the one or more teeth will cut into and break the seal. According to a further embodiment the receptacle has first ratchet teeth that mate with second ratchet teeth on the seal cutter, such that the seal cutter may only be rotated in one direction relative to the receptacle. According to a further embodiment the receptacle has rotationally stationary first stops that engage with second stops on interior surface of the seal cutter, so as to prevent the seal cutter from being rotated relative to the receptacle to a distance sufficient to cut into the seal, until a force greater than a determined breaking force is applied. According to a further embodiment when the cutter is rotated fully, the seal cutter forms a fluid tight barrier with the exterior walls of the channel, but not with the channel exit. According to a further embodiment the seal cutter has a conduit that is aligned with a channel exit of the receptacle. According to a further embodiment the conduit extends into a crevice defined in an interior of the applicator. According to a further embodiment the conduit extends between one half and three fourths a distance from a base of the applicator to a top of the applicator, and a top end of the conduit defines a plurality of crenulations encircling a conduit exit. According to a further embodiment the applicator has a tapered shape, with a base of the applicator multiple times wider than a top of the applicator. According to a further embodiment the applicator is a foam brush. According to a further embodiment the receptacle is made of one of polypropalene or polyethylene. According to a further embodiment the receptacle base is transparent and the receptacle walls are opaque. According to a further embodiment the paint tester includes a volume of paint substantially filling an interior of the receptacle.

The present invention further relates to products and methods of testing paint using a paint tester having a sealed receptacle containing paint, a foam applicator, and a seal cutter, comprising rotating the seal cutter with respect to the receptacle until one or more teeth will cut into and break a seal on the receptacle, applying inward pressure to an exterior surface of a receptacle wall causing paint to flow from the receptacle through a channel exit of the receptacle, through a conduit defined in the seal cutter, out a conduit exit encircled by crenulations, through pores in the applicator, and onto an exterior surface of the applicator, and touching the exterior surface of the applicator to a surface upon which paint is desired.

The present invention further relates to methods and paint testers comprising a sealed receptacle having a base, a receptacle wall, and a channel, a foam brush applicator, a seal cutter, a cap which removablely encapsulating and providing a substantially fluid tight barrier around the applicator, wherein the channel has channel walls defining a space in fluid communication with an interior of the receptacle, a seal extends over a channel exit providing a fluid tight barrier to the interior of the receptacle, the seal cutter engages with an exterior surface of the channel walls, the seal cutter has one or more teeth extending in a direction of the seal, the seal cutter has a threaded interior surface that mates with a threaded exterior surface of the channel walls, such that when the seal cutter is rotated with respect to the receptacle, the one or more teeth will cut into and break the seal, the receptacle has first ratchet teeth that mate with second ratchet teeth on the seal cutter, such that the seal cutter may only be rotated in one direction relative to the receptacle, the receptacle has rotationally stationary first stops that engage with second stops on interior surface of the seal cutter, so as to prevent the seal cutter from being rotated relative to the receptacle to a distance sufficient to cut into the seal, until a force greater than a determined breaking force is applied, when the cutter is rotated fully, the seal cutter forms a fluid tight barrier with the exterior walls of the channel, while providing a fluid path from the channel exit to a seal cutter conduit that is aligned with the channel exit, the conduit extends into a crevice defined in an interior of the applicator, the conduit extends between one half and three fourths a distance from a base of the applicator to a top of the applicator, and a top end of the conduit defines a plurality of crenulations encircling a conduit exit, the applicator has a tapered shape, with a base of the applicator multiple times wider than a top of the applicator, the receptacle is made of one of polypropylene or polyethylene, the receptacle base is transparent and the receptacle walls are opaque, and a volume of paint substantially fills an interior of the receptacle.

In one embodiment, the paint tester is substantially the same size as a lipstick container, preferably between 2.0 and 5.0 inches in height and 0.25 and 1.0 inches in width, or more preferably approximately 3.0 inches in height and about 0.50 inch in width.

Various objects, features, aspects, and advantages of the present invention will become more apparent from the following detailed description of preferred embodiments of the invention, along with the accompanying drawings in which like numerals represent like components. The present invention may address one or more of the problems and deficiencies of the current technology discussed above. However, it is contemplated that the invention may prove useful in addressing other problems and deficiencies in a number of technical areas. Therefore the claimed invention should not necessarily be construed as limited to addressing any of the particular problems or deficiencies discussed herein.

BRIEF DESCRIPTION OF THE DRAWINGS

The accompanying drawings, which are incorporated in and constitute a part of the specification, illustrate various embodiments of the invention and together with the general description of the invention given above and the detailed description of the drawings given below, serve to explain the principles of the invention. It is to be appreciated that the accompanying drawings are not necessarily to scale since the emphasis is instead placed on illustrating the principles of the invention. The invention will now be described, by way of example, with reference to the accompanying drawings in which.

DETAILED DESCRIPTION OF THE PREFERRED EMBODIMENTS

Figure 1:
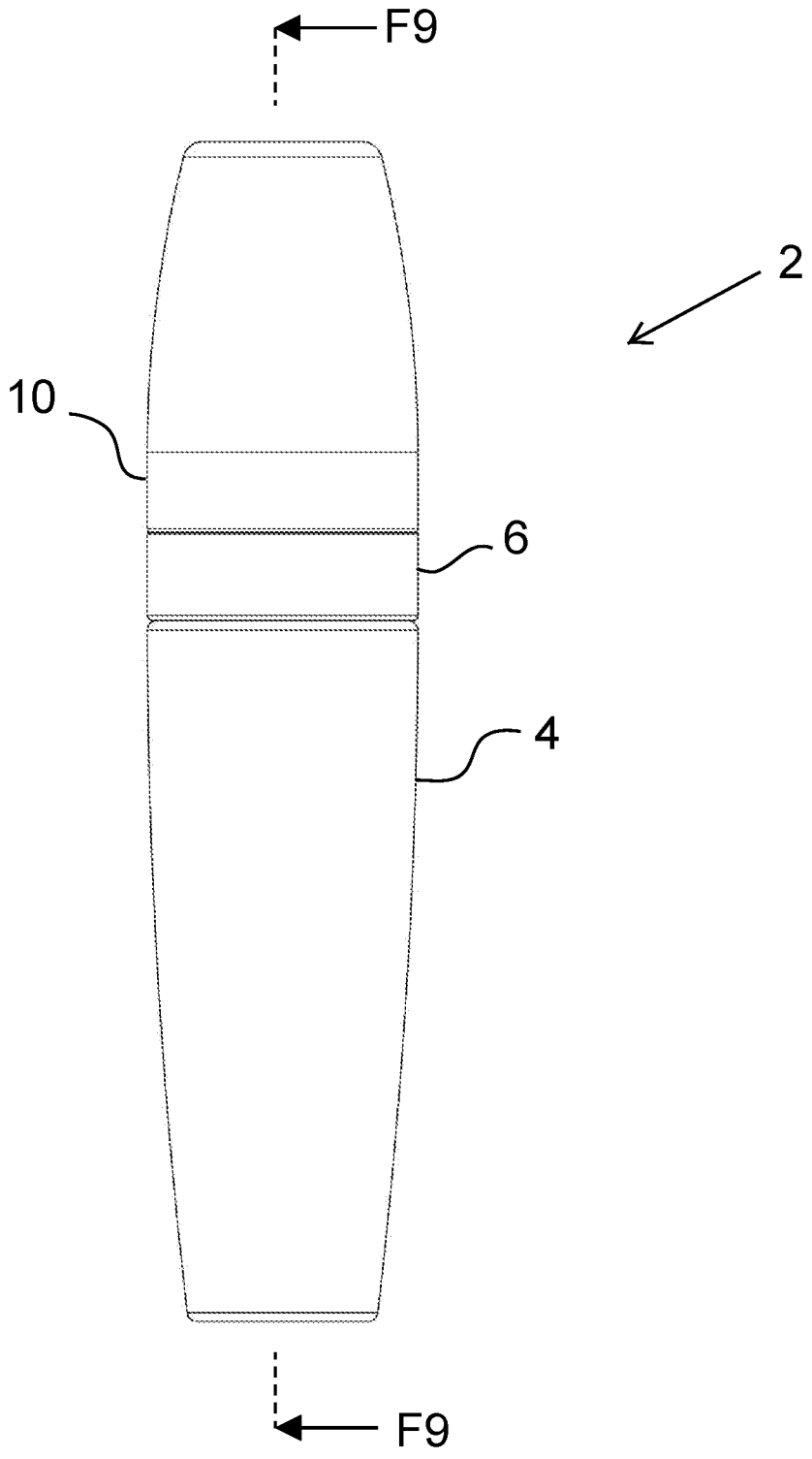
FIG. 1 is a front plan view of the paint tester according to a first embodiment of the present invention.
Figure 2A:
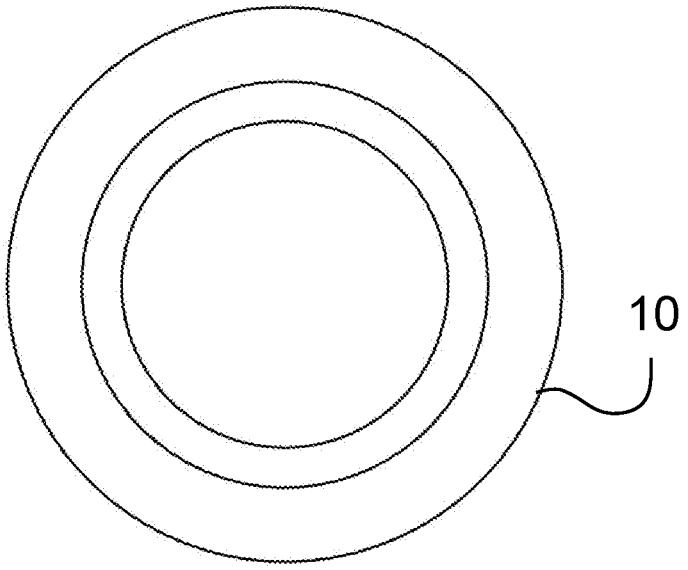
FIGS. 2A and 2B are respective top plan and bottom plan views of the paint tester of FIG. 1.
Figure 2B:
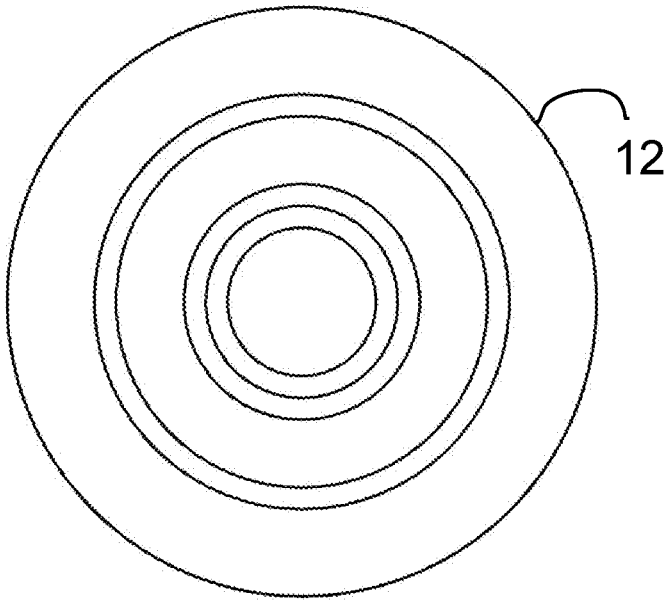
Figure 3:
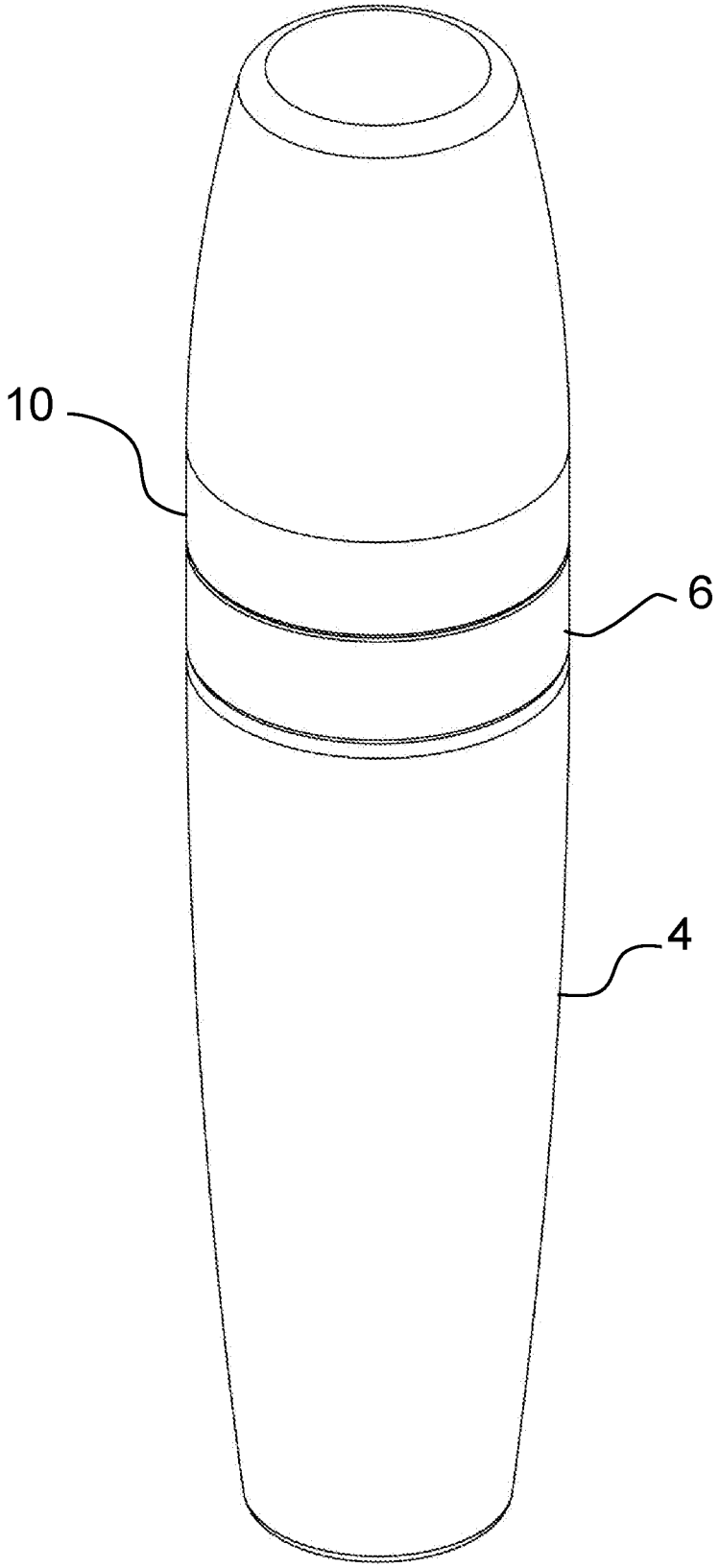
FIG. 3 is an isometric view of the paint tester of FIG. 1.
Figure 4A:
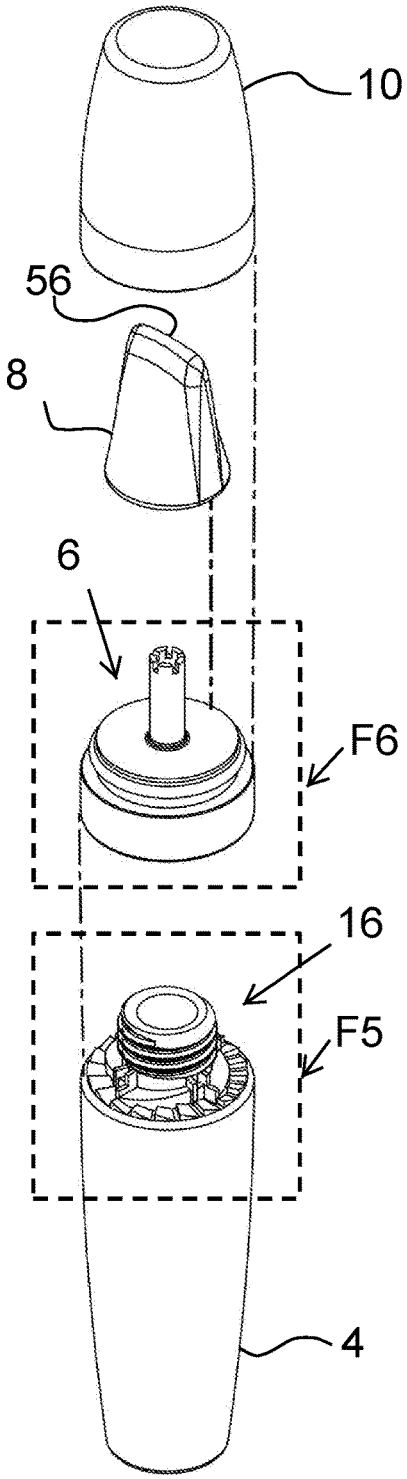
FIGS. 4A and 4B are respective exploded top front right isometric and exploded bottom front left isometric views of the paint tester of FIG. 1.
Figure 4B:
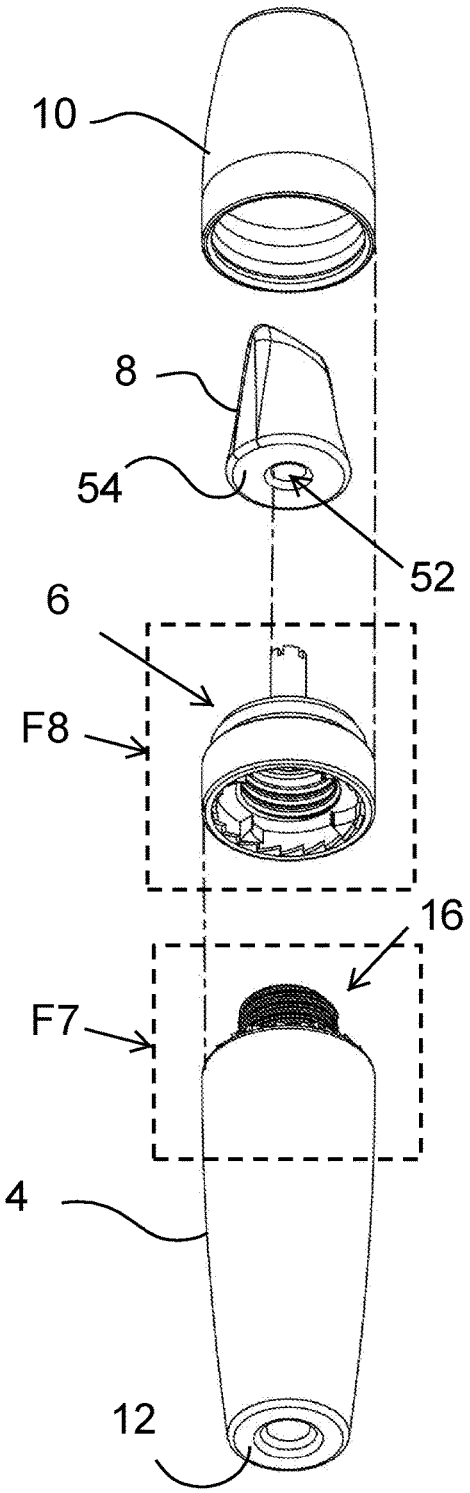
Figure 5:
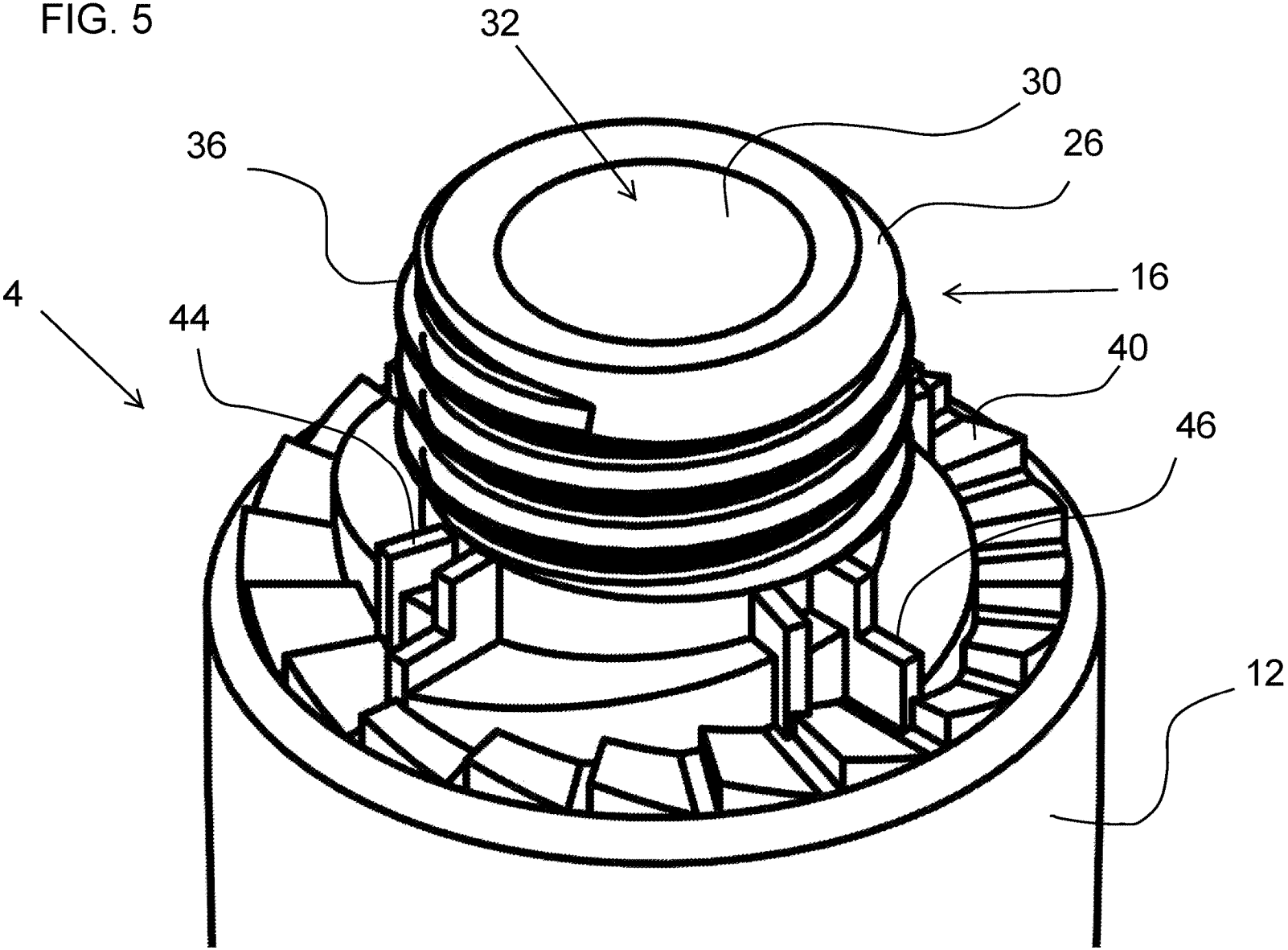
FIG. 5 is an enlarged view of the portion of FIG. 4A within the box marked F5.
Figure 6:
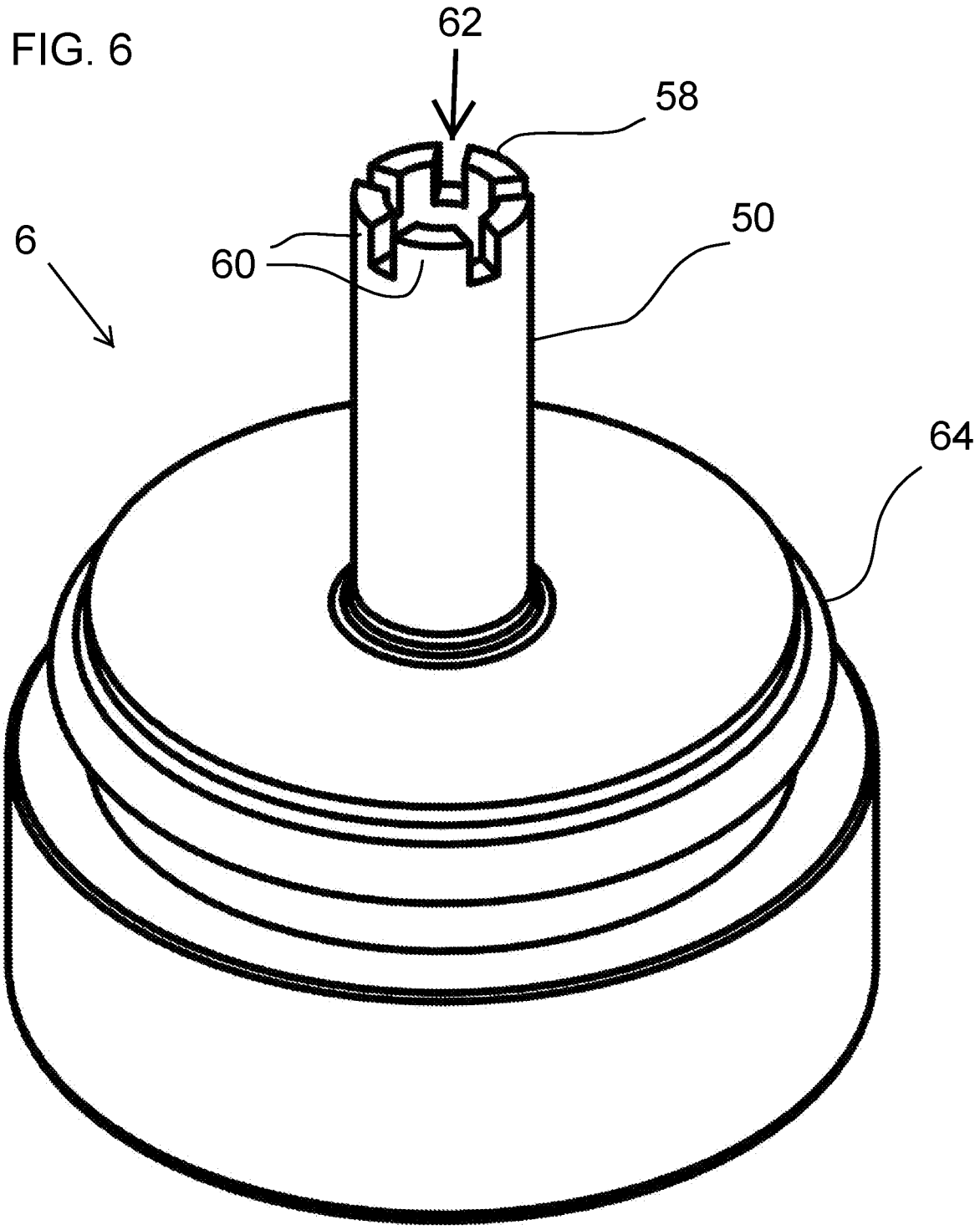
FIG. 6 is an enlarged view of the portion of FIG. 4A within the box marked F6.
Figure 7:
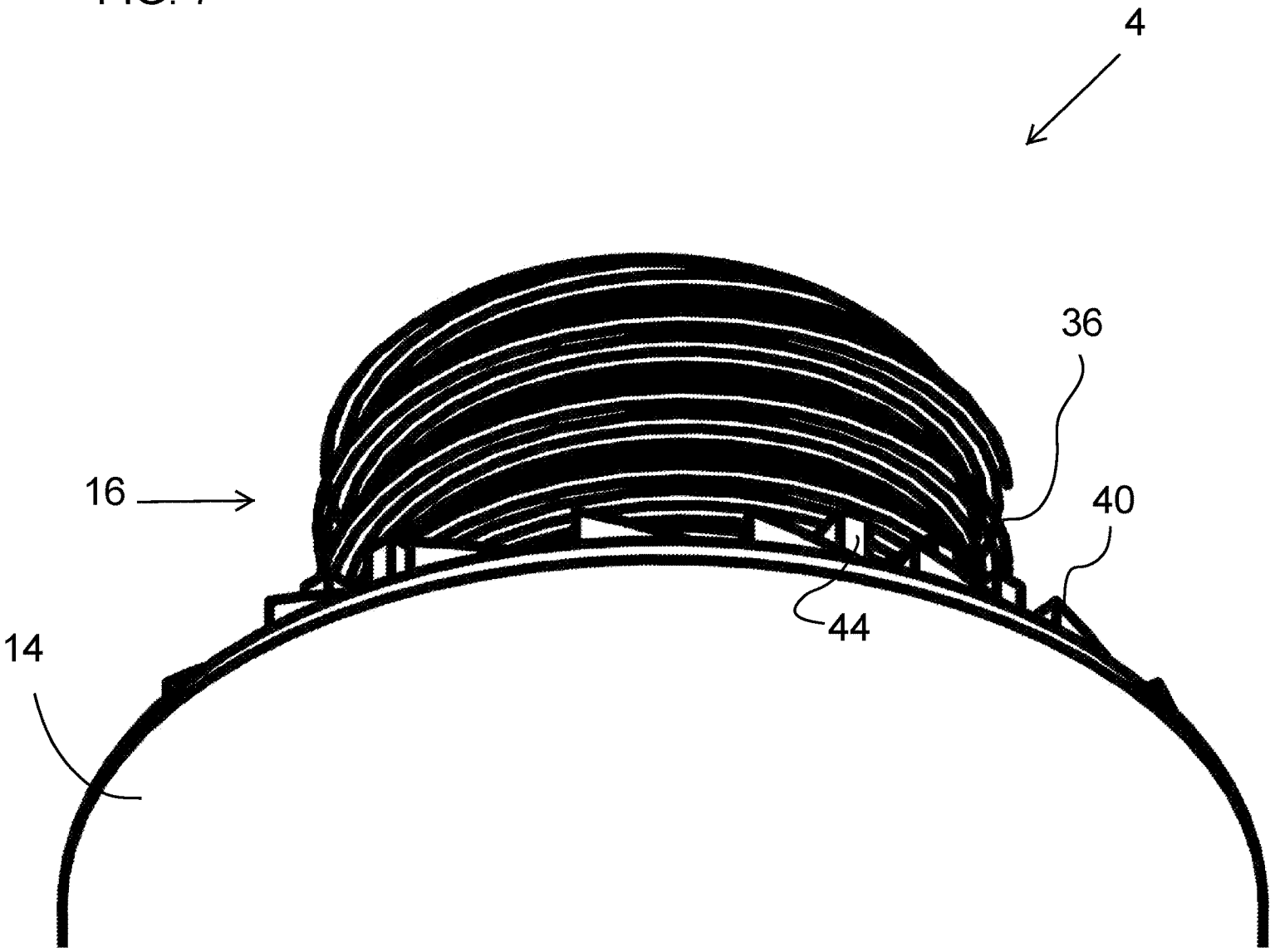
FIG. 7 is an enlarged view of the portion of FIG. 4B within the box marked F7.
Figure 8:
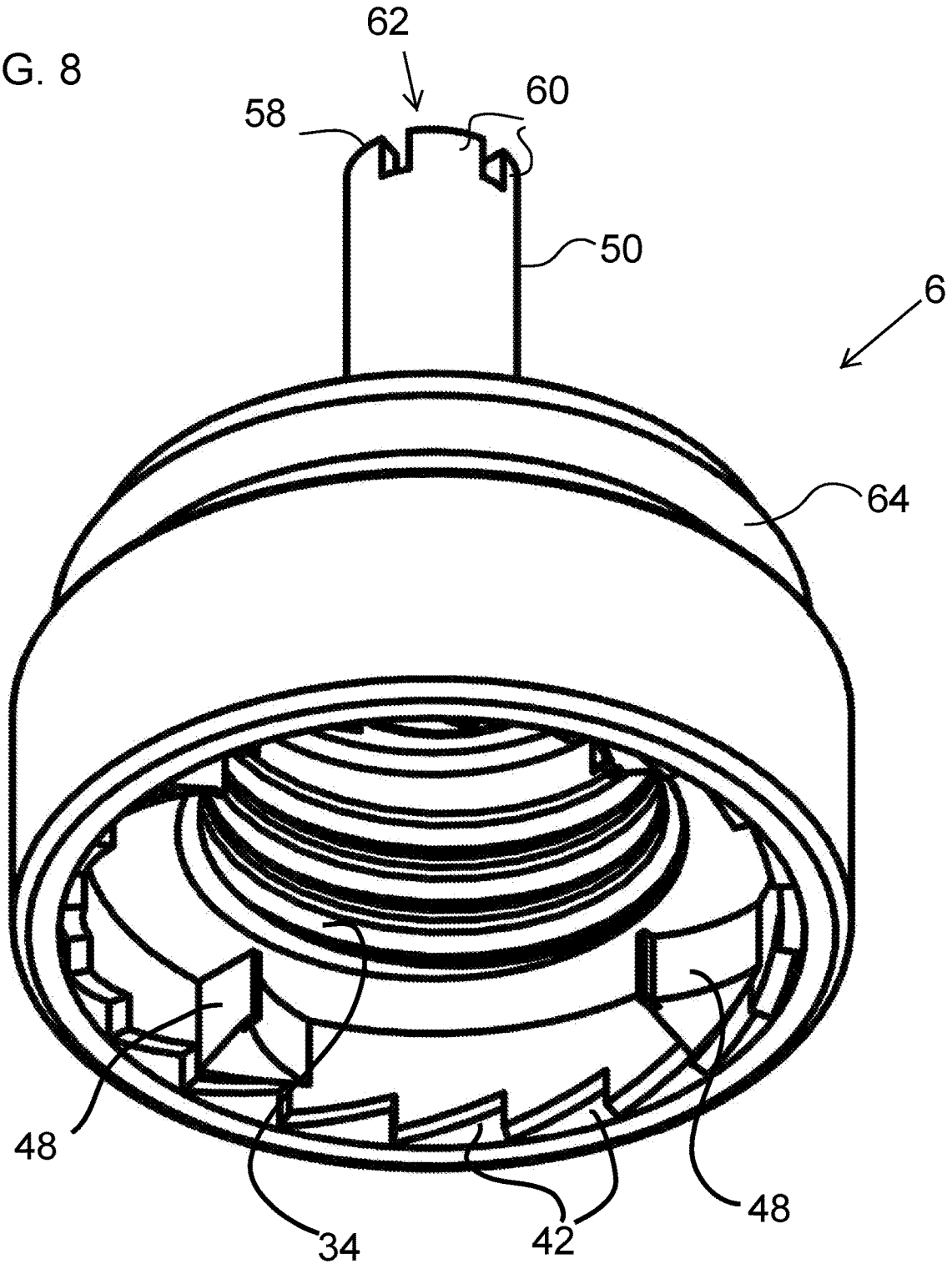
FIG. 8 is an enlarged view of the portion of FIG. 4B within the box marked F8.

The present invention will be understood by reference to the following detailed description, which should be read in conjunction with the appended drawings. It is to be appreciated that the following detailed description of various embodiments is by way of example only and is not meant to limit, in any way, the scope of the present invention. In the summary above, in the following detailed description, in the claims below, and in the accompanying drawings, reference is made to particular features (including method steps) of the present invention. It is to be understood that the disclosure of the invention in this specification includes all possible combinations of such particular features, not just those explicitly described. For example, where a particular feature is disclosed in the context of a particular aspect or embodiment of the invention or a particular claim, that feature can also be used, to the extent possible, in combination with and/or in the context of other particular aspects and embodiments of the invention, and in the invention generally. The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also one or more other components. Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)–(a second number)," this means a range whose lower limit is the first number and whose upper limit is the second number. For example, 25 to 100 mm means a range whose lower limit is 25 mm, and whose upper limit is 100 mm. The embodiments set forth the below represent the necessary information to enable those skilled in the art to practice the invention and illustrate the best mode of practicing the invention. In addition, the invention does not require that all the advantageous features and all the advantages need to be incorporated into every embodiment of the invention.

Turning now to FIGS. 1-10, a brief description concerning the various components of the present invention will now be briefly discussed. As can be seen in this embodiment, the paint tester 2 comprises a receptacle 4, a seal cutter 6, and an applicator 8. The paint tester may also include a cap 10.

The receptacle 4 is a preferably elongate container with a base 12, a wall 14 extending from the base 12, and a channel 16, all defining an interior 18 of the receptacle 4. The channel 16 is connected to an upper portion of the wall 14 by a ledge 20. The wall 14 is preferably opaque, to prevent paint 22 held within the receptacle 4 from being exposed to light. In some embodiments, the wall 14 may be all or partly transparent. In some embodiments including an all or partly transparent wall 14, an opaque covering, such as a wrapping, may be included to block light. Where there is an opaque covering, a clear window in the wrapping, preferably with removable an opaque flap, may be provided, to allow a purchaser to see the true color of the paint 22. In other embodiments, the receptacle 4 may have a transparent base 12, and preferably either an opaque wall 14 or a transparent wall 14 with an opaque covering. This would allow a purchaser to lift up the paint tester 2 and turn it over to see the true color of the paint 22, but still block light from reaching the paint 22 if the paint tester 2 was stored in an upright position, with the base 12 adjacent to a base of a storage or display box or other surface.

The wall 14, base 12, and channel 16 are preferably formed of a polymer plastic, such as, for example, polypropylene and polyethylene. Other plastics could include PLA or other biodegradable plastics.

The paint 22 stored inside the paint tester 2 is preferably latex paint. In other embodiments, an oil-based paint 22 could be stored in the paint tester, preferably with a metal or other lining on the inner surface 24 of the receptacle 4 that resists degradation from oil.

The channel 16 has channel walls 26 defining a channel space 28 in fluid communication with a remaining interior 18 of the receptacle 4. A seal 30 extends over a channel exit 32, and provides a fluid tight barrier to the interior 18 of the receptacle 4.

The seal cutter 6 preferably has threaded radially interior seal cutter walls 34, which matingly engage with threaded exterior channel walls 36. The seal cutter 6 has one or more teeth 38, aligned with and extending in a direction of the seal 30, but preferably initially spaced from the seal 30. When the seal cutter 6 is rotated with respect to the receptacle 4, the mating threaded walls 34, 36 cause the respective rotational motion to also cause linear and downward motion on the seal cutter 6, downward being in a direction toward the base 12 of the receptacle 4. With continued respective rotation, the one or more teeth 38 on the seal cutter 6 will cut into and break the seal 30 that extends over the channel exit 32, and thereby break the fluid tight barrier to the interior 18 of the receptacle 4 and the paint 22 stored within.

When the seal cutter 6 is rotated fully, such that the seal cutter 6 is fully screwed onto the channel 16 and further relative rotation is mechanically prevented, the seal cutter 6 forms a fluid tight barrier with the exterior walls 36 of the channel 16, while providing an opening to the channel exit 32.

Once the seal 30 is opened, the seal cutter 6 is preferably prevented from unscrewing from the channel 16, and thereby failing to maintain a fluid barrier and allowing unintended paint 22 leakage. To prevent relative unscrewing between the seal cutter 6 and the receptacle 4, the receptacle 4 has first ratchet teeth 40 that mate with second ratchet teeth 42 on the seal cutter 6. The respective alignment of the first and second ratchet teeth 40, 42 allow the seal cutter 6 to only be rotated in one direction relative to the receptacle 4, and thus prevent unscrewing of the seal cutter 6.

To prevent the seal cutter 6 from being inadvertently rotated with respect to the receptacle 4—before a paint tester 2 is purchased for example—and thus prematurely cutting into and breaking the seal 30, the receptacle 4 has first stops 44 and full stops 46 disposed on an exterior of the receptacle adjacent to the threaded exterior channel walls 36. The first stops 44, in the form of breakable tabs 44, engage with second stops 48 on a radially interior surface of the seal cutter 6, and resist relative rotation of the seal cutter 6 and receptacle 4 up to a breaking force threshold. Past the breaking force threshold the tabs 44 would break or fold and allow the seal cutter 6 to continue to rotate around the receptacle 4. Thereby, the first and second stops 44, 48 prevent the seal cutter 6 from being inadvertently rotated relative to the receptacle 4 a distance sufficient to cut into the seal 30. The breaking force would be a twisting force or torque of a magnitude large enough to provide substantial tactile feedback, but small enough that an average adult could easily overcome it. The breaking force is preferably between 0.1 and 5.0 Nm, more preferably between 0.5 and 3.0 Nm, and most preferably between 1.0 and 2.0 Nm. The optional full stops 46 would engage the second stops 48 a given distance of rotation past the first stops 44, and fully prevent the seal cutter 6 from being over tightened and striping the treads on the threaded interior seal cutter walls 34 and threaded exterior channel walls 36.

In alternative embodiments, first stops 44 may be more robust, resisting folding or breaking, and be disposed on a removable stop collar that encircles the exterior of the channel walls 26. The stop collar would be rotationally stationary with respect to the receptacle 4, but removable, either by peeling off, or pulling up over the channel exit 32, for example. Thereby, the first and second stops 44, 48 prevent the seal cutter 6 from being rotated relative to the receptacle 4 a distance sufficient to cut into the seal 30, until the stop collar is removed.

The seal cutter 6 has a conduit 50 that is aligned with the channel exit 32 of the receptacle 4. The conduit 50 extends into a crevice 52 defined in an interior of the applicator 8. The conduit 50 preferably extends between one half and three fourths a distance from the applicator base 54 to the applicator top 56, and a conduit top end 58 defines a plurality of crenulations 60 encircling a conduit exit 62. Perforations may be used in place of or in addition to the crenulation 60 to help disperse paint 22 from the conduit exit 62.

A snap fit is preferably formed between the cap 10 and the seal cutter 6, when the cap 10 is fully seated on the seal cutter 6. In the embodiment shown, the snap fit is formed with a circumferential ridge 64 on the exterior circumference of the seal cutter 2 and a mating circumferential grove 66 on the interior circumference of the cap 10. This snap fit provides for a fluid tight barrier around the applicator when the cap is fully seated on the seal cutter 6. In further embodiments the ridge 64 may be on the cap 10 and the grove 66 on the seal cutter 6. In still further embodiments, other fluid tight designs allowing the removable attaching of the cap 10 to the seal cutter 6 may be provided, including mating threaded surfaces.

Figure 9:
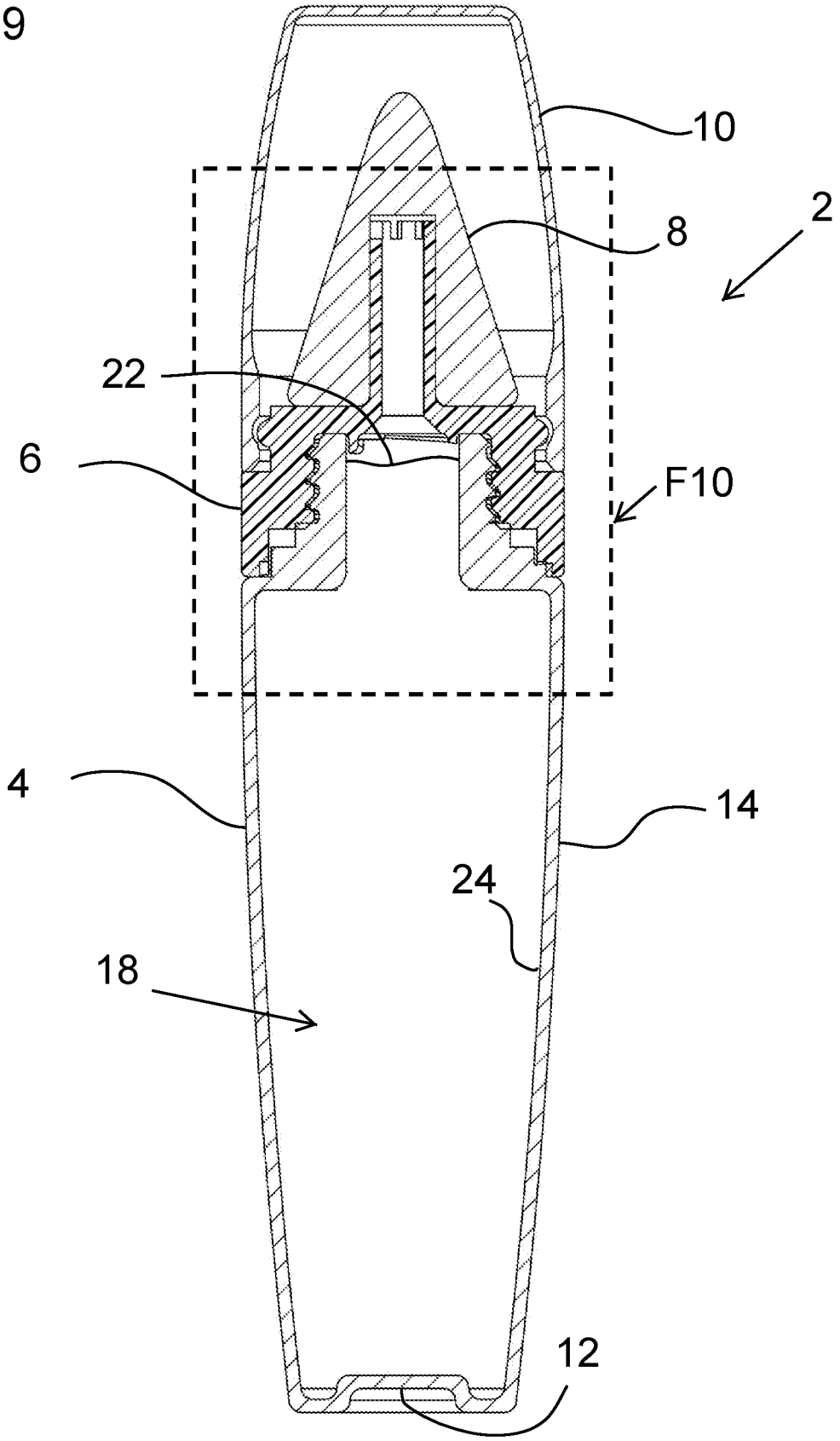
FIG. 9 is a sectional view of paint tester of FIG. 1 along the sectional line F9.
Figure 10:
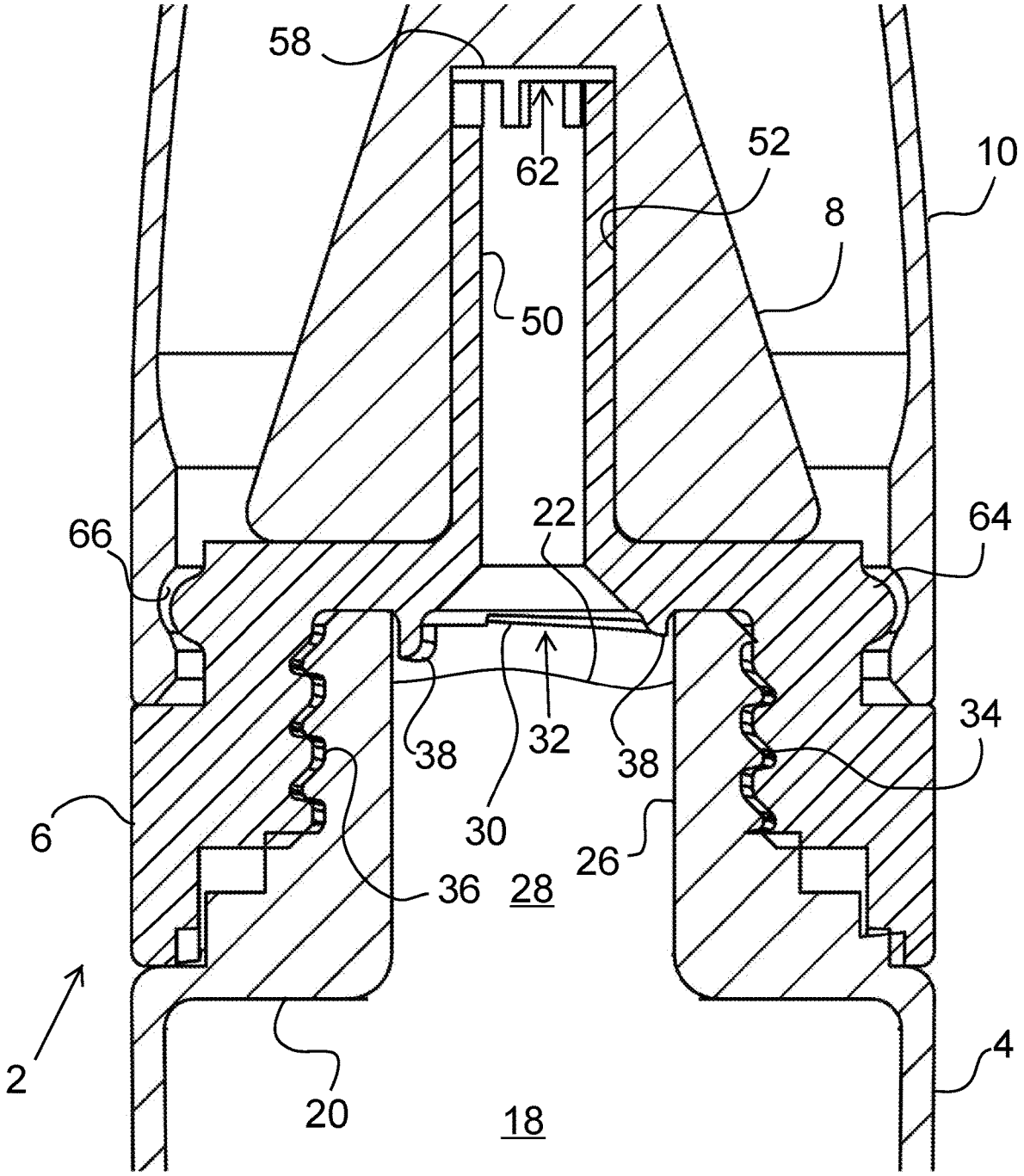
FIG. 10 is an enlarged view of the portion of FIG. 9 within the box marked F10.

The applicator 8 preferably has a tapered shape, allowing for even paint 22 dispersion and a more natural painting motion when a user applies the paint 22 to a surface. As shown in FIG. 9, for example, at least one width the applicator base 54 is preferably multiple times wider than the applicator top 56. The applicator 8 is preferably made of a porous foam, which allows fluid to pass through from the crevice 52 to an exterior of the applicator.

To use the paint tester, the user would first either apply a breaking force to turn the second stops 48 past the tabs 44, as in one embodiment, or would remove the stop collar 46, as in another embodiment. The seal cutter 6 would then be rotated with respect to the receptacle 4 until one or more seal cutter teeth 38 cut into and break the seal 30 on the receptacle 4. The user would then apply an inward pressure to an exterior surface of a receptacle wall 14, such as squeezing the wall 14 inwardly with his or her hand, causing paint 22 to flow from the receptacle 4 through the channel exit 32 of the channel, through the conduit 50 defined in the seal cutter 6, out the conduit exit 62 encircled by crenulations 60, through pores in the applicator 8, and onto an exterior surface of the applicator 8. The user would then touch the exterior surface of the applicator 8 to a surface upon which paint 22 is desired, causing the paint 22 previously stored in the interior of the receptacle to attach to the surface upon which paint 22 is desired.

In the embodiment shown, there is substantial exterior radial symmetry, and the left, right, and back plan view of the paint tester of FIG. 1 would look identical to FIG. 1. In other embodiments, that exterior radial symmetry may not be present.

The invention illustratively disclosed herein suitably may explicitly be practiced in the absence of any element which is not specifically disclosed herein. While various embodiments of the present invention have been described in detail, it is apparent that various modifications and alterations of those embodiments will occur to and be readily apparent those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items while only the terms "consisting of" and "consisting only of" are to be construed in the limitative sense.

We claim:

1. A paint tester comprising:
a sealed receptacle;
an applicator; and
a seal cutter;
wherein the seal cutter has a conduit that is aligned with a channel exit of the receptacle and the conduit extends into a crevice defined in an interior of the applicator; and
the conduit extends between one half and three fourths a distance from a base of the applicator to a top of the applicator, and a top end of the conduit defines a plurality of crenulations encircling a conduit exit.

2. The paint tester of claim 1 further comprising a cap which removably encapsulates and provides a substantially fluid tight barrier around the applicator.

3. The paint tester of claim 1 wherein the sealed receptacle includes a base, a receptacle wall, and a channel.

4. The paint tester of claim 3 wherein the channel has a channel walls defining a space in fluid communication with an interior of the receptacle.

5. The paint tester of claim 4 wherein a seal extending over a channel exit provides a fluid tight barrier to the interior of the receptacle.

6. The paint tester of claim 5 wherein the seal cutter engages with an exterior surface of the channel walls.

7. The paint tester of claim 5 wherein the seal cutter has one or more teeth extending in a direction of the seal.

8. The paint tester of claim 7 wherein the seal cutter has a threaded interior surface that mates with a threaded exterior surface of the channel walls, such that when the seal cutter is rotated with respect to the receptacle, the one or more teeth will cut into and break the seal.

9. The paint tester of claim 8 wherein the receptacle has first ratchet teeth that mate with second ratchet teeth on the seal cutter, such that the seal cutter may only be rotated in one direction relative to the receptacle.

10. The paint tester of claim 8 wherein the receptacle has rotationally stationary first stops that engage with second stops on interior surface of the seal cutter, so as to prevent the seal cutter from being rotated relative to the receptacle to a distance sufficient to cut into the seal, until a force greater than a determined breaking force is applied.

11. The paint tester of claim 10, wherein, when the cutter is rotated fully, the seal cutter forms a fluid tight barrier with the exterior walls of the channel, but not with the channel exit.

12. A paint tester comprising:
a sealed receptacle;
an applicator; and
a seal cutter;
wherein the sealed receptacle includes a base, a receptacle wall, and a channel;
the channel has a channel walls defining a space in fluid communication with an interior of the receptacle;
a seal extending over a channel exit provides a fluid tight barrier to the interior of the receptacle;
the seal cutter has one or more teeth extending in a direction of the seal;
the seal cutter has a threaded interior surface that mates with a threaded exterior surface of the channel walls, such that when the seal cutter is rotated with respect to the receptacle, the one or m ore teeth will cut into and break the seal; and
the receptacle has first ratchet teeth that mate with second ratchet teeth on the seal cutter, such that the seal cutter may only be rotated in one direction relative to the receptacle.

13. The paint tester of claim 1 wherein the applicator has a tapered shape, with a base of the applicator multiple times wider than a top of the applicator.

14. The paint tester of claim 1 wherein the applicator is a foam brush.

15. The paint tester of claim 1 wherein the receptacle is made of one of polypropalene or polyethylene.

16. The paint tester of claim 1 wherein the receptacle base is transparent and the receptacle walls are opaque.

17. The paint tester of claim 1 further comprising a volume of paint substantially filling an interior of the receptacle.

18. A paint tester comprising:
a sealed receptacle having a base, a receptacle wall, and a channel;
a foam brush applicator;
a seal cutter;
a cap removably encapsulating and providing a substantially fluid tight barrier around the applicator;
wherein
the channel has channel walls defining a space in fluid communication with an interior of the receptacle;
a seal extends over a channel exit providing a fluid tight barrier to the interior of the receptacle;
the seal cutter engages with an exterior surface of the channel walls;
the seal cutter has one or more teeth extending in a direction of the seal;
the seal cutter has a threaded interior surface that mates with a threaded exterior surface of the channel walls, such that when the seal cutter is rotated with respect to the receptacle, the one or more teeth w ill cut into and break the seal;
the receptacle has first ratchet teeth that mate with second ratchet teeth on the seal cutter, such that the seal cutter may only be rotated in one direction relative to the receptacle;
the receptacle has rotationally stationary first stops that engage with second stops on interior surface of the seal cutter, so as to prevent the seal cutter from being rotated relative to the receptacle to a distance sufficient to cut into the seal, until a force greater than a determined breaking force is applied, the seal cutter, when rotated fully, forms a fluid tight barrier with the exterior walls of the channel and provides a fluid path from the channel exit to a seal cutter conduit that is aligned with the channel exit;

the conduit extends into a crevice defined in an interior of the applicator;

the conduit extends between one half and three fourths a distance from a base of the applicator to a top of the applicator, and a top end of the conduit defines a plurality of crenulations encircling a conduit exit;

the applicator has a tapered shape, with a base of the applicator multiple times wider than a top of the applicator;

the receptacle is made of one of polypropylene or polyethylene;

the receptacle base is transparent and the receptacle walls are opaque; and a volume of paint substantially fills an interior of the receptacle.

19. The paint tester of claim 12 wherein the seal cutter has a conduit that is aligned with a channel exit of the receptacle and the conduit extends into a crevice defined in an interior of the applicator.

* * * * *